United States Patent [19]

Jäggle et al.

[11] Patent Number: 4,515,128

[45] Date of Patent: May 7, 1985

[54] FUEL INJECTION SYSTEM

[75] Inventors: Günther Jäggle, Stuttgart; Wolfgang Maisch, Schwieberdingen; Klaus-Jürgen Peters, Affalterbach; Rudolf Schütz, Ditzingen, all of Fed. Rep. of Germany

[73] Assignee: Robert Bosch GmbH, Stuttgart, Fed. Rep. of Germany

[21] Appl. No.: 541,606

[22] Filed: Oct. 13, 1983

[30] Foreign Application Priority Data

Dec. 28, 1982 [DE] Fed. Rep. of Germany ..... 3248258

[51] Int. Cl.[3] ..... F02M 39/00

[52] U.S. Cl. ..... 123/454

[58] Field of Search ..... 123/452, 453, 454, 455, 123/458, 459

[56] References Cited

U.S. PATENT DOCUMENTS

| | | | |
|---|---|---|---|
| 3,930,481 | 1/1976 | Eckert | 123/452 |
| 3,993,032 | 11/1976 | Passera et al. | 123/452 |
| 4,075,995 | 2/1978 | Kramer | 123/454 |
| 4,132,195 | 1/1979 | Bianchi et al. | 123/454 |
| 4,353,385 | 10/1982 | Maisch et al. | 123/511 |
| 4,364,361 | 12/1982 | Eckert | 123/453 |
| 4,381,751 | 5/1983 | Maisch et al. | 123/454 |

*Primary Examiner*—Magdalen Y. C. Moy
*Attorney, Agent, or Firm*—Edwin E. Greigg

[57] ABSTRACT

A fuel injection system which serves to adapt the fuel-air mixture accurately over a wide range to operating conditions of the internal combustion engine. The fuel injection system includes metering valves, with each of which a regulating valve is associated, the movable valve element of which can be acted upon on one side by the fuel pressure downstream of the particular metering valve and on the other side by the pressure in a differential pressure control line, which is defined on one end by a first electrofluidic converter of the nozzle/baffle type and on the other end by a first throttle. The first electrofluidic converter is triggerable in accordance with operating characteristics of the engine and determines the pressure in the differential pressure control line and thus, via the regulating valves, the differential pressure at the metering valves. The control slide of the metering valves protrudes with one end face into a pressure chamber, which communicates with a restoring force pressure control line in which the pressure, and thus the restoring force exerted upon the control slide, is variable by means of a second electrofluidic converter, which communicates via an uncoupling throttle with the fuel supply line.

1 Claim, 1 Drawing Figure

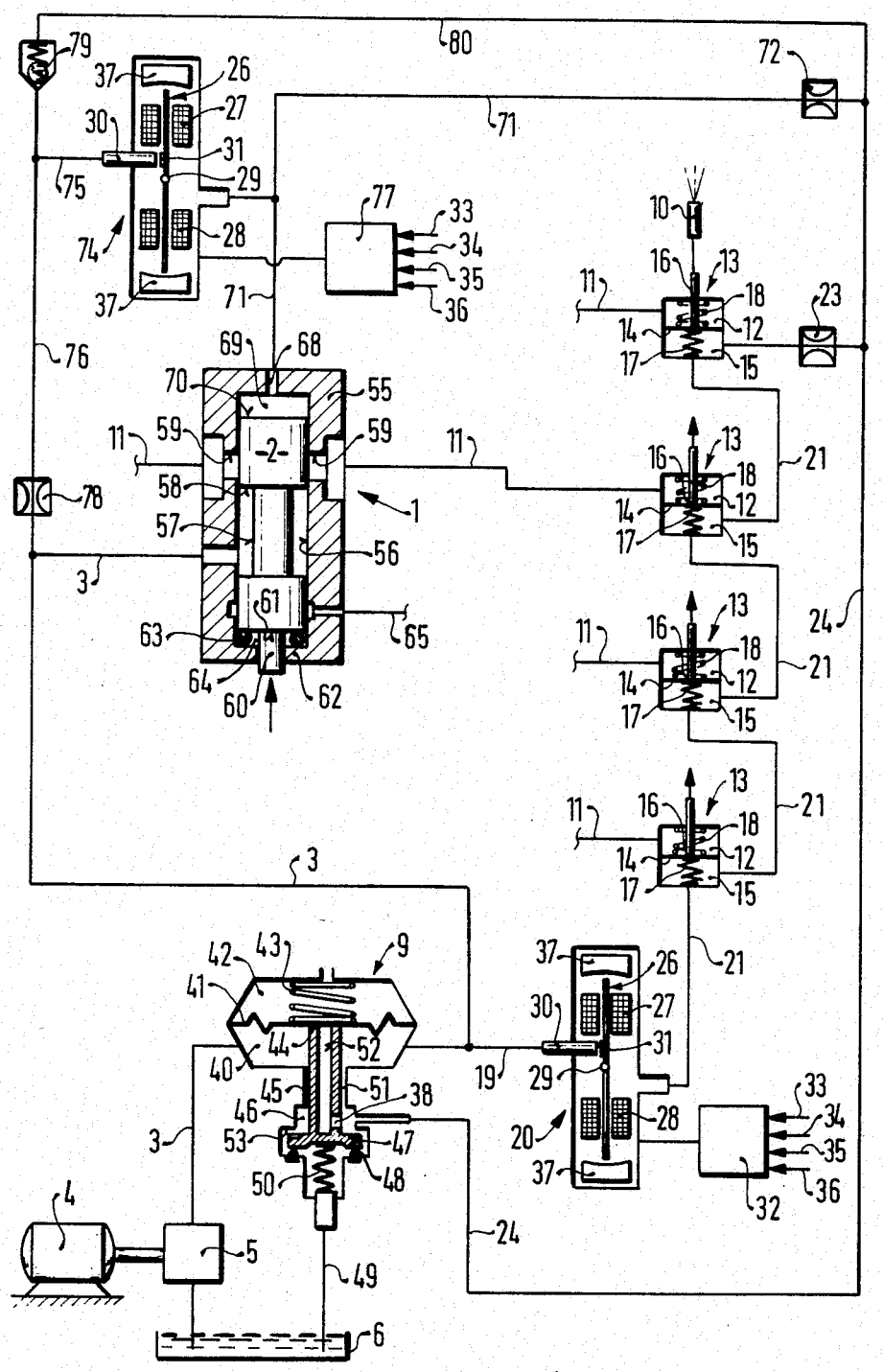
79
80
72
37
26
27
30
31
29
71
75
77
33
34
35
36
74
28
10
16
13
11
18
23
14
12
17
15
76
69
68
70
55
59
-2-
78
58
57
1
56
3
61
63
65
64
60
62
21
24
9
42
43
41
44
52
40
45
51
38
46
53
47
50
48
19
20
32
4
5
49
6

FUEL INJECTION SYSTEM

BACKGROUND OF THE INVENTION

The invention is based on a fuel injection system for an internal combustion engine having an external ignition. A fuel injection system is already known in which the fuel-air mixture is variable by varying the differential pressure at fuel metering valves by means of an electrofluidic converter; as a result, however, mixture regulation is possible only within a limited range.

OBJECT AND SUMMARY OF THE INVENTION

The fuel injection system according to the invention has the advantage that the fuel-air mixture can be regulated over a very wide range, with air numbers lambda of from about 0.4 to 1.6.

As a result of the characteristics disclosed advantageous further developments of and improvements to the fuel injection system disclosed are attainable. It is particularly advantageous to reduce, by means of the uncoupling throttle, the pressure at which the second electrofluidic converter has to operate and by means of the pressure regulating valve to make this pressure independent of the fuel quantity.

The invention will be better understood and further objects and advantages thereof will become more apparent from the ensuing detailed description of a preferred embodiment taken in conjunction with the drawing.

BRIEF DESCRIPTION OF THE DRAWING

The single FIGURE of the drawing shows one embodiment of the invention in simplified form.

DESCRIPTION OF THE PREFERRED EMBODIMENT

In the exemplary embodiment of a fuel injection system shown in the drawing, a metering and quantity distribution valve 1 is shown, one metering valve opening 59 being associated with each cylinder of a mixture-compressing internal combustion engine with externally supplied ignition (not shown). At the metering valve, a quantity of fuel is metered which is in a specific proportion to the quantity of air aspirated by the engine. The fuel injection system shown by way of example has four metering valve openings 59, of which two are shown, and is thus intended for a four-cylinder engine. The cross section of each of the metering valves is variable, for instance in common, by means of a control slide 2 serving as a movable metering valve element, in accordance with operating characteristics of the engine, for instance in a known manner in accordance with the quantity of air aspirated by the engine. The metering valve is connected to a fuel supply line 3, into which fuel is fed from a fuel container 6 by a fuel pump 5 driven by an electric motor 4. In the fuel supply line 3, there is a pressure limitation valve 9 which limits the fuel pressure prevailing in the fuel supply line 3 and when this limit is exceeded allows fuel to flow back to the fuel container 6 via line 49.

Downstream of each metering valve opening, a line 11 is provided, by way of which the metered fuel passes into a regulating chamber 12 of a regulating valve 13 separately associated with each metering valve. The regulating chamber 12 of the regulating valve 13 is divided by a movable regulating valve element such as a diaphragm 14 from a control chamber 15 of the regulating valve 13. The diaphragm 14 of the regulating valve 13 cooperates with a fixed valve seat 16 provided in the regulating chamber 12, by way of which valve seat 16 the metered fuel can flow out of the regulating chamber 12 to the individual injection valves 10, only one of which is shown, in the intake tube of the engine. A differential pressure spring 18 may be disposed in the regulating chamber 12, urging the diaphragm 14 in the opening direction of the regulating valve 13. A closing spring 17 may likewise be disposed in the control chamber 15, the spring force of which is greater than that of the differential pressure spring 18, so that when the engine is shut off the diaphragm 14 is held against the valve seat 16 and will not execute any stroke movement toward the valve seat 16 upon the starting of the engine.

From the fuel supply line 3, a line 19 branches off, discharging fuel via a first electrofluidic converter 20 of the nozzle/baffle type. Fuel from the electrofluidic converter is discharged into a differential pressure control line 21. The control chambers 15 of the regulating valves 13 are disposed downstream of the first electrofluidic converter 20 in the differential pressure control line 21, and a first throttle 23 is disposed downstream of the control chambers 15. Fuel is capable of flowing out of the differential pressure line 21 into an outflow line 24 via the first throttle 23. The first electrofluidic converter 20 of the nozzle/baffle type is known per se and will therefore be described here only briefly in terms of its function and operation. The first electrofluidic converter 20 includes a rocker 26, upon which a variable moment of deflection is exerted, for instance electromagnetically by means of coils 27, 28, so that it undergoes a certain deflection about a pivot 29. The line 19 discharges at a nozzle 30 in the first electrofluidic converter 20 opposite a baffle plate 31 disposed on the rocker 26. At a constant moment of deflection engaging the rocker 26, a pressure drop is thus produced between the nozzle 30 and the baffle plate 31 which is so great that a constant pressure difference, dependent on the moment of deflection, is established between the fuel pressure in the line 19 and the fuel pressure in the differential pressure control line 21. The triggering of the first electrofluidic converter 20 is effected via an electronic control unit 32 in accordance with appropriately entered operating characteristics of the engine such as rpm 33, throttle valve position 34, temperature 35, exhaust gas composition (oxygen sensor) 36 and others. The triggering of the first electrofluidic converter 20 by the electronic control unit 32 may be effected either in analog fashion or in clocked increments. In the non-excited state of the first electrofluidic converter 20, it is possible by means of suitable spring forces or permanent magnets 37 on the rocker 26 to generate a basic moment such that a pressure difference is established which will assure emergency operation of the engine even if the electrical triggering fails.

In the presence of control signals characterizing engine overrunning, such as an rpm above the idling rpm level with the throttle valve closed, the first electrofluidic converter 20 can be excited in such a manner that the fuel pressure in the differential pressure control line 21 increases to such an extent that the regulating valves 13 close, thus precluding fuel injection via the injection valves 10.

The pressure limitation valve 9 has a system pressure chamber 40, which communicates with the fuel supply line 3 via the line 19 and is separated by means of a valve diaphragm 14 from a spring chamber 42, which communicates with the atmosphere and in which a system pressure spring 43 is disposed, which urges the valve diaphragm 41 in the closing direction of the valve seat 44. The valve seat 44 which cooperates with the valve diaphragm 41 is formed on one end of a conduit 52 which is axially displaceably supported on an axial bearing location 45 and protrudes into the system pressure chamber 40. The end of the conduit 52 remote from the valve diaphragm 41 protrudes all the way out of the axial bearing location 45 into a collecting chamber 46 and is embodied as a valve plate 47. The conduit 52 is provided with a radial outlet 38. The valve plate 47 opens or closes a sealing seat 48, which may be embodied as a rubber ring, by way of which fuel can flow into a return flow line 49 and from there to the intake side of the fuel pump 5, for instance back to the fuel container 6. A closing compression spring 50 is supported on the valve plate 47, urging the valve plate 47 in the opening direction and having the tendency to displace the valve seat 44 counter to the force exerted upon the valve seat 44 via the valve diaphragm 41. A throttle gap 51 is provided in the axial bearing location 45 between the system pressure chamber 40 and the collecting chamber 46. All the fuel lines discharge into the collecting chamber 46, for instance the outflow line 24, by way of which the fuel is supposed to flow back to the fuel container. The radial outlet 38 is provided in conduit 52 so that fuel can flow into the collecting chamber 46 when the valve diaphragm 41 is raised away from the valve seat 44. The cross section of the valve plate 47 acted upon by fuel is smaller than the valve diaphragm cross section 41, and the elastic sealing seat 48 has approximately the size size cross section as the valve plate 47.

The function of the pressure limitation valve 9 is as follows:

When the engine is off, the valve plate 47 rests on the sealing seat 48 and closes the return flow line 49, while the valve diaphragm 41 closes the valve seat 44. When the engine is started, the fuel pump 5 pumps fuel into the fuel supply line 3 and thus into the system pressure chamber 40 of the pressure limitation valve 9 as well. If this pressure rises beyond a predetermined opening pressure, at which the fuel pressure force exerted upon the valve diaphragm 41 and the spring force of the closing pressure spring 50 are greater than the spring force of the system pressure spring 43 and the fuel pressure force exerted upon the valve plate 47, then the valve plate 47 rises from the sealing seat 48, and the valve seat 44 is displaced toward the valve diaphragm 41. This displacement movement is limited by a stop 53, against which the valve plate 47 comes to rest. If a fuel pressure now determined only by the spring force of the system pressure spring 43 (i.e., the system pressure) is now attained, then the valve diaphragm 41 rises from the valve seat 44, and fuel can flow out via the conduit 52 into the collecting chamber 46 and from there into the return flow line 49. When the engine is shut off or upon the interruption of the fuel supply on the part of the fuel pump 5, the valve diaphragm 41 closes the valve seat 44. The spring forces of the system pressure spring 43 and the closing pressure spring 50 and the cross sections of the valve diaphragm 41 and valve plate 47 acted upon by fuel are adapted to one another such that at first fuel continues to be capable of flowing via the throttle gap 51 into the collecting chamber 46 and from the collecting chamber 46 via the sealing seat 48 into the return flow line 49, until the fuel pressure in the fuel injection system is lower than that required for opening the injection valves 10. Not until the pressure falls below the fuel pressure required for opening the injection valves 10 is the valve plate 47 displaced so far, counter to the force of the closing pressure spring 50, that it comes to rest on the sealing seat 48, blocking off the return flow line 49. The valve plate 47 is additionally pressed against the sealing seat 48 now by the fuel pressure prevailing in the collecting chamber 46. As a result, leakage of fuel out of the fuel injection system is prevented, so that when the engine is next started again the fuel injection system will be functionally ready in the shortest possible time. If the engine is now started again, then the required opening pressure at which the valve plate 47 rises from the sealing seat 48 is greater than the pressure required for closing, since no balancing of forces between the pressure forces exerted by the fuel pressure in the collecting chamber 46 takes place at the valve plate 47 in the closed state. An opening pressure which is increased relative to the closing pressure is desirable, however, in order to assure reliable closing, even if after the engine has been shut off the fuel pressure in the fuel injection system increases because of the warming up of the confined fuel.

The metering and quantity distribution valve 1 has a metering sheath 55, in which the control slide 2 is supported in an axially displaceable manner in a sliding bore 56. The control slide 2 has an annular control groove 57, which is defined on one end by a control edge 58. Upon an upward displacement, the control edge 58 opens more of the control openings 59, for instance control slits, by way of which fuel can flow out, having been metered in quantity, into the lines 11. With each control opening 59, the control edge 58 of the control slide 2 forms one metering valve, the two of which located in the plane of the drawing are shown, while the two others, not located in the plane of the drawing, are offset by 90° with respect to the two metering valve openings shown. An air flow rate meter, not shown, may by way of example and in a known manner engage the control slide 2 on the actuation side, on an actuation end 60, for instance, so that the air flow rate meter displaces the control slide 2 in accordance with the quantity of air aspirated by the engine. At the transition to the actuation end 60 which has the smaller cross-section, a step 61 is formed. The actuation end 60 is surrounded and engaged by a radial wall 62 and thus seals off the sliding bore 56 from below. An elastic sealing ring 63 is disposed on the radial wall 62, and in the position of rest on the control slide 2 the step 61 comes to rest on this sealing ring 63 and thus effects sealing from the outside. In the operating position of the control slide 2, a leakage space 64 is formed between the step 61 and the radial wall 62 which intercepts the fuel leaking out of the control groove 57 via the outer circumference of the control slide 2 and from which a leakage line 65 leads to the collecting chamber 46 of the pressure limitation valve 9. The restoring force on the control slide 2 acting counter to the actuation force acting upon the actuation end 60 is generated by fuel. To this end, the control slide 2 includes an end face 70 which is embodied on the end of the control slide 2 remote from the actuation end 60 and protrudes into a pressure chamber 69 that communicates via a damping throttle 68 with a restoring force pressure control line 71 which branches off from the fuel supply line 3 via an electrofluidic converter 74. The restoring force pressure control line 71 is defined at one end by a second throttle 72, by way of which fuel can flow out of the restoring force pressure control line 71, for instance into the outflow line 24 and back to the container 6. On the other end, the restoring force pressure control line 71 is defined by a second electrofluidic converter 74 of the nozzle/baffle type, the nozzle 30 embodying the inlet communicates via a line 75 to an intermediate line 76. The second electrofluidic converter 74 is similar in its design and function to the first electrofluidic converter 20, so that it need not be described again here. The triggering of the second electrofluidic converter may be effected by an electronic control unit 77, to which the operating characteristics 33, 34, 35, 36 can be fed. Instead of being triggered by the electronic control unit 77, the second electrofluid converter 74 can also be triggered by the electronic control unit 32. The intermediate line 76 communicates via an uncoupling throttle 78 with the fuel supply line 3. By means of the uncoupling throttle 78, a desired pressure drop is effected in the intermediate line 76, so that it is possible to operate at a lower pressure at the second electrofluidic converter 74. The pressure in the intermediate line 76 is regulatable in a manner independent of the fuel quantity by means of a pressure regulating valve 79. The fuel flowing out via the pressure regulating valve 79 can be carried by means of a line 80 to the outflow line 24 and back to the container 6.

Controlling the differential pressure at the metering valves 58, 59 by means of the first electrofluidic converter 20 and controlling the restoring force exerted upon the control slide 2 by varying the fuel pressure in the restoring force pressure control line 71 by means of the second electrofluidic converter 74 makes it possible to vary the fuel-air ratio over a very wide range, from about lambda=0.4 to lambda=1.6.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. A fuel injection system for mixture-compressing internal combustion engines with externally supplied, ignition, comprising a metering sheath, a plurality of metering openings in said metering sheath which are variable in common by a movable control slide, said control slide including an annular control groove, a fuel metering valve disposed in a fuel supply line and intended for metering a quantity of fuel which is at a specific ratio to a quantity of air aspirated by the engine, said control slide opens metering openings more or less widely counter to a restoring force, said control slide includes one end which protrudes into a compression chamber, a restoring force pressure control line which communicates with said compression chamber and with the fuel supply line so that metering takes place at a pressure difference which is constant but is variable in accordance with operating characteristics of the engine, a regulating valve disposed downstream of each metering valve opening, each said regulating valve including a movable valve element which regulates the pressure difference at each metering valve acted upon on one side by the fuel pressure downstream of the particular metering valve opening and on the other side by the pressure in a differential pressure control line, a first electrofluidic converter of the nozzle/baffle type which is triggerable in accordance with operating characteristics of the engine and serves to apply a differential pressure in the differential pressure control line from the fuel supply line, to one side of said movable valve element, a throttle element downstream of said regulating valves and connected on one side to a fuel return line, the fuel pressure in the restoring force pressure control line is variable by means of a second electrofluidic converter of the nozzle/baffle type, which is triggerable in accordance with engine operating characteristics and is disposed upstream of a second throttle defining the restoring force pressure control line and connected at one end to said fuel return line, said second electrofluidic converter including an inlet which communicates with an intermediate line, which at one end communicates via an uncoupling throttle with the fuel supply line and the intermediate line is defined on the other end by a pressure regulating valve.

* * * * *